US008646863B2

(12) United States Patent
Takei

(10) Patent No.: US 8,646,863 B2
(45) Date of Patent: Feb. 11, 2014

(54) INK JET RECORDING HEAD

(75) Inventor: Yasunori Takei, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 184 days.

(21) Appl. No.: 13/016,873

(22) Filed: Jan. 28, 2011

(65) Prior Publication Data

US 2011/0193904 A1 Aug. 11, 2011

(30) Foreign Application Priority Data

Feb. 8, 2010 (JP) ..... 2010-025866

(51) Int. Cl.
*B41J 29/38* (2006.01)

(52) U.S. Cl.
USPC ..... 347/14; 347/12; 347/65

(58) Field of Classification Search
USPC ..... 347/65, 12, 14
See application file for complete search history.

(56) References Cited

U.S. PATENT DOCUMENTS

| | | | | |
|---|---|---|---|---|
| 5,519,423 | A * | 5/1996 | Moritz et al. | 347/65 |
| 5,793,393 | A * | 8/1998 | Coven | 347/65 |
| 6,042,222 | A * | 3/2000 | Moritz et al. | 347/65 |
| 6,053,599 | A * | 4/2000 | Maeda | 347/65 |
| 6,409,318 | B1 * | 6/2002 | Clark | 347/65 |
| 6,447,088 | B2 * | 9/2002 | Tachihara et al. | 347/65 |
| 6,652,079 | B2 * | 11/2003 | Tsuchii et al. | 347/65 |
| 7,641,317 | B2 * | 1/2010 | Matsui et al. | 347/65 |
| 7,850,286 | B2 * | 12/2010 | Edelen et al. | 347/65 |
| 7,963,635 | B2 * | 6/2011 | Oikawa et al. | 347/65 |
| 8,042,923 | B2 * | 10/2011 | Matsumoto | 347/65 |
| 8,061,818 | B2 * | 11/2011 | Murakami | 347/65 |
| 8,087,759 | B2 * | 1/2012 | Oikawa et al. | 347/65 |
| 8,162,446 | B2 * | 4/2012 | Tomizawa et al. | 347/65 |
| 8,205,979 | B2 * | 6/2012 | Nishitani et al. | 347/65 |
| 2010/0283819 | A1 * | 11/2010 | Tamaru et al. | 347/65 |

FOREIGN PATENT DOCUMENTS

JP 5-57890 A 3/1993

* cited by examiner

*Primary Examiner* — Julian Huffman
(74) *Attorney, Agent, or Firm* — Canon USA, Inc., IP Division

(57) ABSTRACT

An ink jet recording head includes a nozzle array and discharge energy generation elements. The nozzles include discharge ports to discharge liquid when recording, pressure chambers to communicate with respective discharge ports, and liquid flow paths to supply liquid to the respective pressure chambers. The discharge energy generation elements apply discharge energy to the pressure chambers to discharge liquid from the nozzles in a predetermined order during time-division driving. Arranging intervals of the liquid flow paths take at least two different values. When a drive timing difference average between the adjacent discharge energy generation elements is calculated by a particular expression, a relationship of D≥Y is satisfied between an interval D and an interval Y in a k-th discharge energy generation element and a k+1-th discharge energy generation element positioned adjacent to the k-th discharge energy generation element. The intervals D and Y represent distances between particular liquid flow paths.

19 Claims, 7 Drawing Sheets

| NOZZLE NO. | n1 | n2 | n3 | n4 | n5 | n6 | n7 | n8 | n9 | n10 | n11 | n12 | n13 | n14 | n15 | n16 | (n17) |
|---|---|---|---|---|---|---|---|---|---|---|---|---|---|---|---|---|---|
| BLOCK NO. | 15 | 9 | 3 | 13 | 7 | 2 | 12 | 6 | 16 | 10 | 4 | 14 | 8 | 1 | 11 | 5 | (15) |

FIG. 3

| NOZZLE NO. | n1 | n2 | n3 | n4 | (n5) |
|---|---|---|---|---|---|
| BLOCK NO. | 3 | 1 | 4 | 2 | (3) |

TIMING DIFERENCE FROM ADJACENT NOZZLE 2 3 2 1

FIG. 6

| NOZZLE NO. | n1 | n2 | n3 | n4 | n5 | n6 | n7 | n8 | n9 | n10 | n11 | n12 | n13 | n14 | n15 | n16 | (n17) |
|---|---|---|---|---|---|---|---|---|---|---|---|---|---|---|---|---|---|
| BLOCK NO. | 15 | 9 | 3 | 13 | 7 | 2 | 12 | 6 | 16 | 10 | 4 | 14 | 8 | 1 | 11 | 5 | (15) |

INK JET RECORDING HEAD

BACKGROUND OF THE INVENTION

1. Field of the Invention

The present invention relates to an ink jet recording head that discharges liquid such as ink to various media to perform recording.

2. Description of the Related Art

For an ink jet recording system, there are a method of using an electrothermal conversion element (heater) and a method of using a piezoelectric element as discharge energy generation elements used for discharging liquid droplets.

The ink jet recording head that performs recording by using such a system generally includes a plurality of discharge ports arranged in a row and pressure chambers communicated with the respective discharge ports. Each pressure chamber includes a discharge energy generation element, and a liquid flow path is connected to the pressure chamber to supply liquid. Liquid is supplied from a common liquid chamber through the liquid flow path.

In the ink jet recording head thus configured, when discharge energy is generated to discharge liquid from a certain discharge port, the energy generates pressure waves not only in a discharge direction but also toward the common liquid chamber through the liquid flow path. The pressure wave generated toward the common liquid chamber is transmitted to an adjacent nozzle to vibrate a liquid surface, causing fluctuation of a discharge amount of ink or unstable discharging.

Recently in particular, a higher density of nozzles, simultaneous driving of the plurality of nozzles for an image of a high recording density, and a higher speed of a recording operation have led to a shorter discharging time interval between adjacent nozzles, making an influence of the pressure wave more conspicuous. Herein, such fluid interaction between the adjacent nozzles is referred to as crosstalk.

Generally, for the nozzles of the ink jet recording head, a time-division drive system is employed. In the system, the nozzles are divided into a predetermined number of groups, in which the nozzles are continuous in position. In the group, the divided nozzles are further divided into drive divisions for respective drive timings, and the time-division drive system drives the discharge energy generation elements in the nozzles at different timings for each drive division (drive block). Employing this drive system enables shifting in drive timing between the adjacent nozzles, and thus crosstalk can be reduced.

There has recently been a request for a higher printing speed of an ink jet recording apparatus. Thus, when drive timings are greatly shifted between the adjacent nozzles to reduce crosstalk, achievement of the higher printing speed is hindered. On the other hand, when an interval in drive timing is set short between the adjacent nozzles to achieve the higher printing speed, a reduction in crosstalk is insufficient, thus affecting printing.

To deal with this problem, Japanese Patent Application Laid-Open No. 5-57890 discusses a method of reducing an influence of crosstalk by appropriately setting resistance of a liquid flow path.

However, the method discussed in Japanese Patent Application Laid-Open No. 5-57890 reduces crosstalk by increasing fluid resistance of a specific nozzle. It consequently takes time to resupply ink, hindering achievement of a higher printing speed.

SUMMARY OF THE INVENTION

The present invention is directed to an ink jet recording head capable of reducing an influence of crosstalk that causes unstable discharging without hindering achievement of a higher printing speed.

According to an embodiment, an ink jet recording head includes a nozzle array and discharge energy generation elements. The nozzle array includes nozzles arranged in an array, where the nozzles include discharge ports to discharge liquid when recording, pressure chambers to communicate with respective discharge ports, and liquid flow paths to supply liquid to the respective pressure chambers. The discharge energy generation elements apply discharge energy to the pressure chambers to discharge liquid from the nozzles in a predetermined order during time-division driving. Arranging intervals of the liquid flow paths take at least two different values. When a drive timing difference average X between the adjacent discharge energy generation elements is calculated by the following expression:

$$\frac{|n_1 - n_2| + |n_2 - n_3| + |n_3 - n_4| + \ldots + |n_{N-1} - n_N| + |n_N - n_{N+1}|}{N} = X$$

a relationship of $D \geq Y$ is satisfied between an interval D and an interval Y in a k-th discharge energy generation element and a k+1-th discharge energy generation element that is adjacent to the k-th discharge energy generation element. In the above expression, N indicates as a quantity that number of divisions for the time-division driving. Here, drive timings of adjacent N discharge energy generation elements are set to $n_1$ for a first discharge energy generation element, $n_2$ for a discharge energy generation element adjacent to the first discharge energy generation element, and similarly set for $n_3$ to $n_N$, where n=1 to N. In the above relationship, the interval D is a distance between a liquid flow path corresponding to a k-th discharge energy generation element where $|n_k - n_{k+1}| < X$ is satisfied, and a liquid flow path corresponding to the k+1-th discharge energy generation element. Moreover, the interval Y is a distance between a liquid flow path corresponding to the k-th discharge energy generation element where $|n_k - n_{k+1}| > X$ is set, and a liquid flow path corresponding to the k+1-th discharge energy generation element.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

FIG. 3 illustrates drive timing when the number of time divisions is four according to the exemplary embodiment.

FIG. 6 illustrates drive timing when the number of time divisions is sixteen according to an exemplary embodiment.

DESCRIPTION OF THE EMBODIMENTS

Various exemplary embodiments, features, and aspects of the invention will be described in detail below with reference to the drawings.

Figure 1:
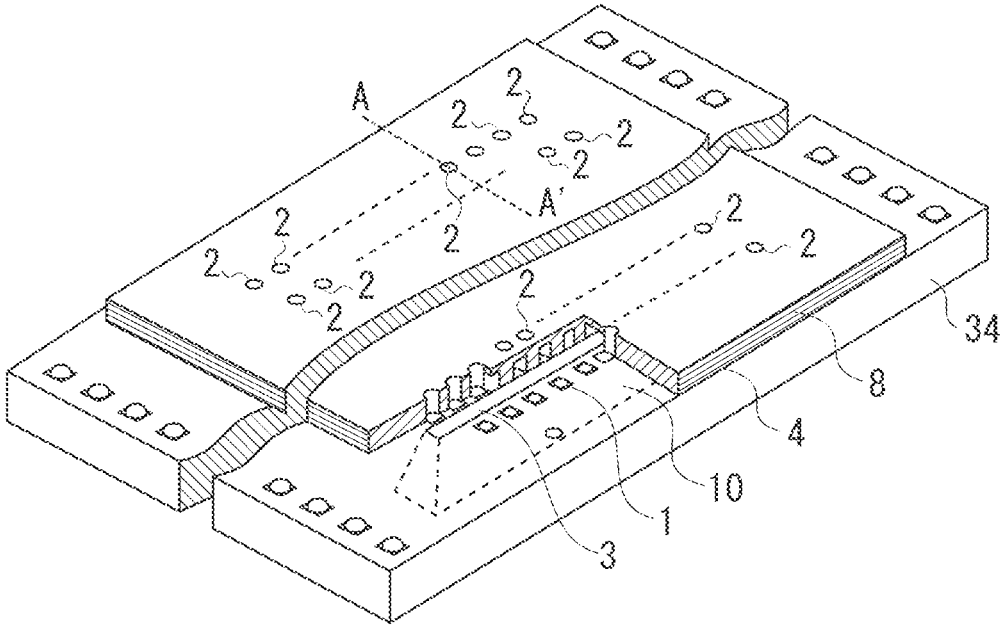
FIG. 1 is a perspective view of a recording head according to an exemplary embodiment.
Figure 2:
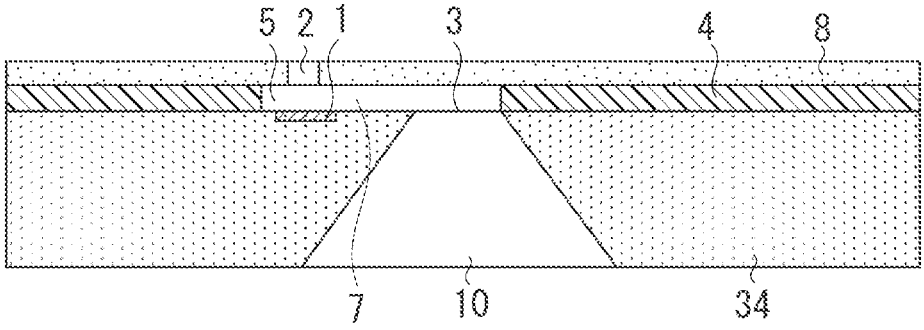
FIG. 2 is a sectional view of the recording head taken along the line A-A' illustrated in FIG. 1.

FIG. 1 is a perspective view of a recording head according to an exemplary embodiment. FIG. 2 is a sectional view of the recording head taken along the line A-A' illustrated in FIG. 1.

A flow path component 4 and a discharge port plate 8 are provided on a substrate 34. An ink supply chamber 10 is connected to a common liquid chamber 6 and a liquid flow path 7 of a discharge portion illustrated in FIG. 4A via an ink supply port 3 of an opening formed on a surface of the substrate 34.

As illustrated in FIG. 1, on one surface of the substrate 34, electrothermal conversion elements 1, which are discharge energy generation elements operated to discharge ink, and a thin and long rectangular ink supply port 3 are formed. The ink supply port 3 is a long groove-shaped opening formed on the surface of the substrate 34, and corresponds to an opening at an end of the ink supply chamber 10. The ink supply chamber 10 is a through-hole provided toward a surface opposite to the surface of the substrate 34 where the electrothermal conversion elements 1 are formed, and connected to the discharge portion via the ink supply port 3.

The electrothermal conversion elements 1 are laid out in a line on each of both sides of the ink supply port 3 in a longitudinal direction at intervals of 600 dots per inch. The flow path component 4 is provided on one surface of the substrate 34, and the discharge port plate 8 is joined onto the flow path component 4. The discharge port plate 8 includes discharge ports 2 corresponding to the electrothermal conversion elements 1.

The substrate 34 functions as a part of the flow path component 4, and any material can be used as long as the material allows the substrate 34 to function as a support member of a material layer on which a discharge energy generation unit, the discharge ports 2, and a flow path described below are formed. For example, glass, ceramics, plastic, or a metal can be used. In the present exemplary embodiment, a silicon substrate is used for the substrate 34.

As illustrated in FIG. 2, the liquid flow path 7 is formed to guide ink from the ink supply port 3 to a pressure chamber 5 on each electrothermal conversion element 1. In the present exemplary embodiment, the pressure chamber 5 is 30 micrometers square. The discharge port plate 8 includes the discharge port 2 formed as an opening to communicate the pressure chamber 5 with the outside. Ink is discharged from the discharge port 2. Herein, the discharge port 2, the pressure chamber 5, and the liquid flow path 7 constitute a nozzle. In the present exemplary embodiment, similar members are used for the discharge port plate 8 and the flow path component 4. However, similar effects can be obtained even when different members are used.

An embodiment is described below. The recording head according to the present exemplary embodiment is described by way of case where the number of time divisions is sixteen, more specifically a case where ink is discharged by time-division driving for each of drive blocks 1 to 16. First, referring to FIG. 3, FIGS. 4A and 4B, and FIGS. 5A to 5C, a mechanism of suppressing crosstalk when the number of time divisions is four is described.

FIG. 3 illustrates nozzle numbers n1 to n5 for five nozzles, and block numbers indicating drive timings of discharge energy generation elements provided corresponding to the respective nozzles. The drive timing indicates an order of driving. FIG. 3 illustrates, below the table, a difference in drive timing between each nozzle and an adjacent nozzle, the drive timing of the adjacent nozzle having been calculated from a drive timing of the discharge energy generation element of each nozzle.

Time intervals for driving the blocks are set equal, and a difference in driving time between adjacent nozzles is determined based on the intervals (block intervals) and the difference in drive timing. The drive timing is repeated for every four nozzles. In FIG. 3, drive timings of the nozzles n1 and n5 are equal.

Figure 4A:
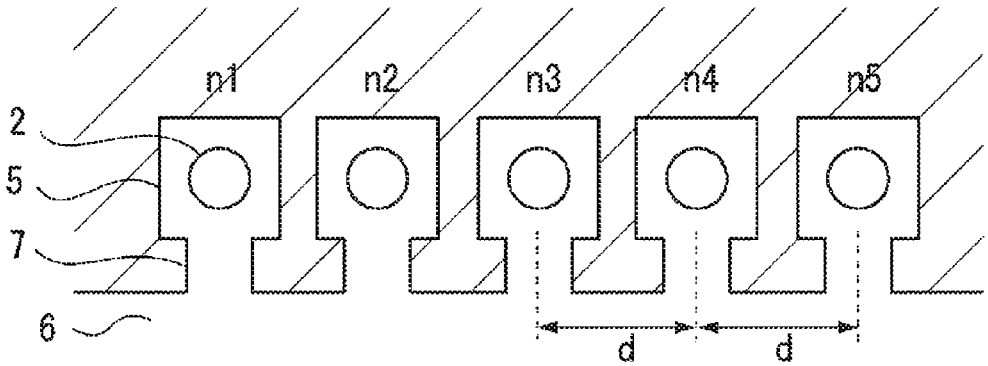
FIG. 4A illustrates a conventional nozzle arrangement when the number of time divisions is four according to the exemplary embodiment.

FIG. 4A illustrates nozzle front view according to a comparative example. Each nozzle includes the discharge port 2, the pressure chamber 5, and the liquid flow path 7, and has a liquid flow path length of 34 micrometers (length from a center of the discharge port to a common liquid chamber) and a liquid flow path width of 14 micrometers. The nozzle is communicated with the common liquid chamber. The liquid flow paths 7 are arranged at equal intervals with a distance d (42 micrometers) between the liquid flow paths, and the intervals are equal to arranging intervals of the pressure chambers 5. These nozzles are driven at the drive timings illustrated in FIG. 3.

In FIGS. 3 and 4A, focusing on the nozzles n3 to n5, ink is discharged in order of n4, n5 and n3. In the configuration illustrated in FIG. 4A, the nozzles are formed at equal intervals of d. Thus, a pressure wave generated by the ink discharging from the nozzle n4 is transmitted almost equally to the nozzles n3 and n5, generating equal meniscus vibrations.

Figure 4B:
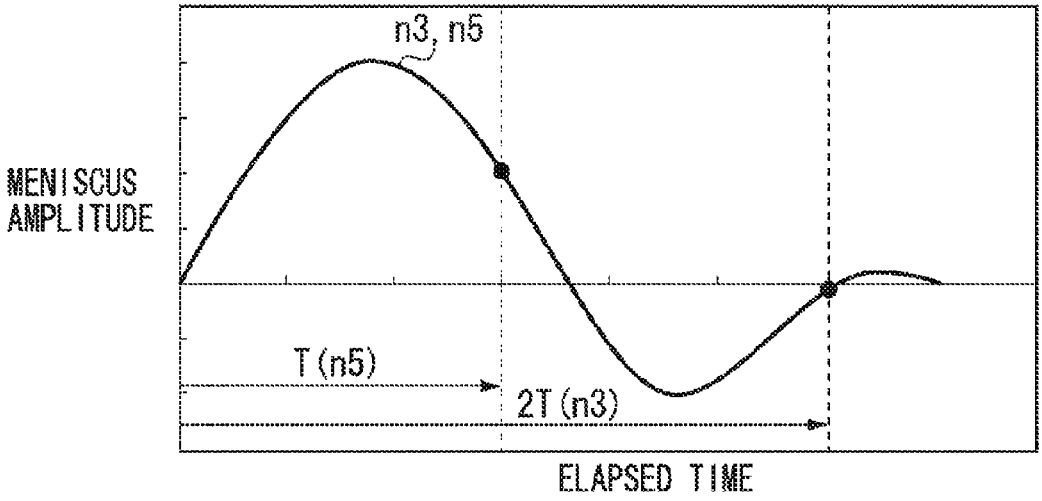
FIG. 4B schematically illustrates a meniscus vibration state of nozzles n3 and n5 caused by discharging of ink from a nozzle n4 in the conventional nozzle arrangement when the number of time divisions is four according to the exemplary embodiment.

FIG. 4B illustrates this state. A horizontal axis indicates a period of elapsed time from a start of a discharge operation from the nozzle n4, and a vertical axis indicates meniscus amplitudes of the nozzles n3 and n5. Meniscus amplitude behaviors are similar between the nozzles n3 and n5. A timing of ink discharging from the nozzle n5 is a one-block interval (T) later after discharging from the nozzle n4, and a timing of ink discharging from the nozzle n3 is a two-block interval (2T) later. This difference in discharge timing causes ink to be discharged from the nozzle n5 in a convex meniscus state. On the other hand, in the nozzle n3, the vibration has been sunk down, and ink is discharged in an almost flat meniscus state.

Figure 5A:
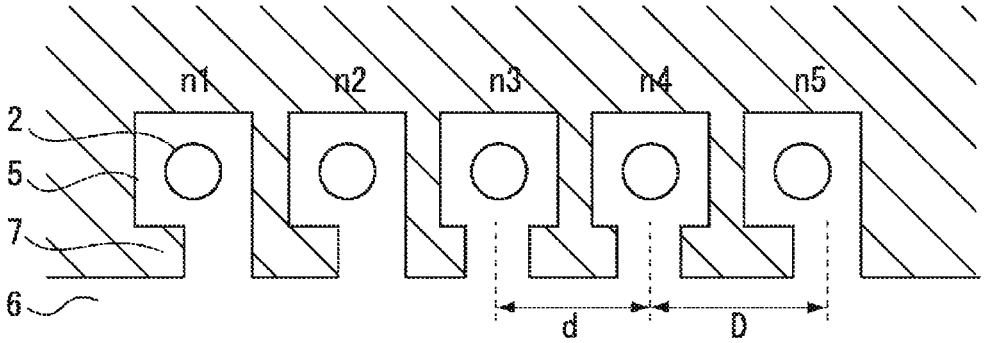
FIG. 5A illustrates a nozzle arrangement when the number of time divisions is four according to the exemplary embodiment.

FIG. 5A illustrates nozzle shapes according to the present exemplary embodiment. Drive timings are similar to those illustrated in FIG. 3. In FIG. 5A, intervals of pressure chambers in a nozzle array illustrated in FIG. 5A are substantially equal.

An average drive timing difference X of the four nozzles is calculated from FIG. 3. Herein, the average drive timing difference means an average value of drive timing differences between the adjacent nozzles. In the four nozzles, the average drive timing difference X can be calculated by the following expression:

$$\frac{|n_1 - n_2| + |n_2 - n_3| + |n_3 - n_4| + |n_4 - n_5|}{4} = X$$

X=2 is acquired from the expression.

Thus, at the drive timings illustrated in FIG. 3, when a timing difference from an adjacent nozzle is larger than 2, a liquid inter-flow-path distance between the adjacent nozzles is approximated to d because a meniscus vibration is small and an influence of crosstalk is small. When a timing difference is smaller than 2, a liquid inter-flow-path distance between the adjacent nozzles is set large from d because a meniscus vibration is relatively large and an influence of crosstalk is large.

When a timing difference from an adjacent nozzle is equal to 2, a liquid inter-flow-path distance between the adjacent nozzles is set equal to d. FIG. 5A illustrates liquid flow paths arranged under such conditions. In FIG. 5A, only a distance between the liquid flow paths is changed while a length and a width of the liquid flow path are not changed at each nozzle.

Figure 5B:
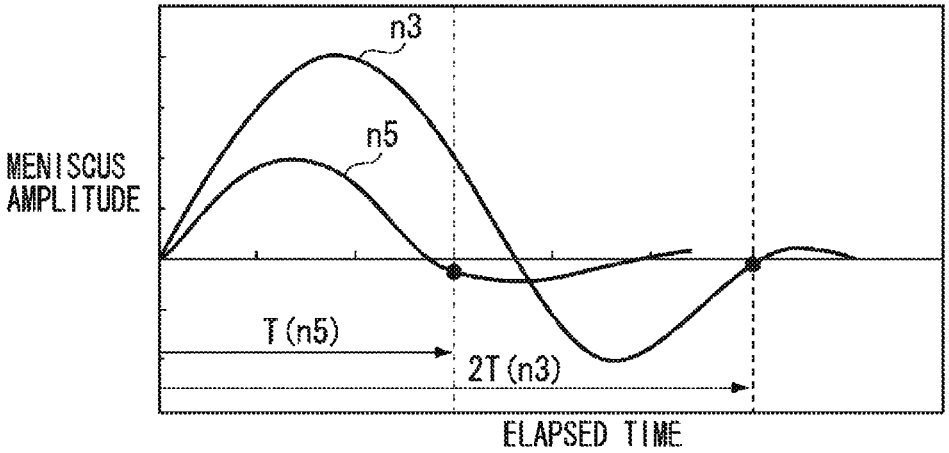
FIG. 5B schematically illustrates a meniscus vibration state of nozzles n3 and n5 caused by discharging of ink from a nozzle n4 in the nozzle arrangement when the number of time divisions is four.

Focusing on the nozzles n3, n4, and n5, in FIG. 5A, a liquid inter-flow-path distance d between the nozzles n3 and n4 is not changed, while a liquid inter-flow-path distance D (50 micrometers) between the nozzles n4 and n5 is larger than the distance d. As illustrated in FIG. 5B, when ink is discharged from the nozzle n4, a meniscus amplitude in the nozzle n3 is not different from that of the comparative example. However, in the nozzle n5, because of the far liquid inter-flow-path distance, a meniscus amplitude is smaller and a vibration cycle is shorter.

A period of time from discharging from the nozzle n4 to discharging from the nozzle n5 is equal to that of the conventional case. However, since the meniscus vibration has been suppressed, ink can be discharged in a near flat meniscus state of both of the nozzles n3 and n5. Thus, the ink can be discharged in a reduced state of a crosstalk influence.

Figure 5C:
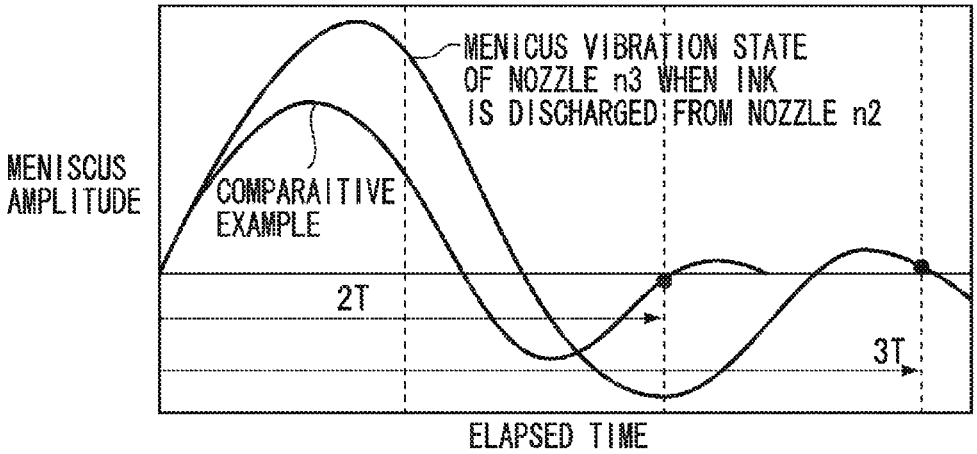
FIG. 5C schematically illustrates meniscus vibration states of the nozzle n3 in a case where ink is discharged from a nozzle n2 in the nozzle arrangement according to the exemplary embodiment when the number of time division is four, and a case where ink is discharged from a nozzle n4 according to a comparative example.

On the other hand, at the nozzles n2 and n3, an inter-flow-path distance is smaller than the distance d. Thus, as illustrated in FIG. 5C, when ink is discharged from the nozzle n2, a meniscus amplitude in the nozzle n3 is larger than the distance d, and a vibration cycle is longer. However, since a discharge timing from the nozzle n3 is a three-block interval (3T) after the discharging from the nozzle n2, a meniscus vibration is suppressed over time, and the ink is discharged in a near flat meniscus state.

Thus, in the liquid flow path arrangement of the equal intervals according to the comparative example, there is fluctuation of ink discharging in the array of nozzles. For example, ink is discharged from one nozzle in an unsuppressed meniscus vibration state, while ink is discharged from another nozzle in a sufficiently suppressed meniscus vibration state. As a result, especially crosstalk between nozzles where discharge timings are close causes unstable discharging.

However, employing the liquid flow path arrangement suitable for the drive timings according to the present exemplary embodiment enables a stable operation.

Figure 7:
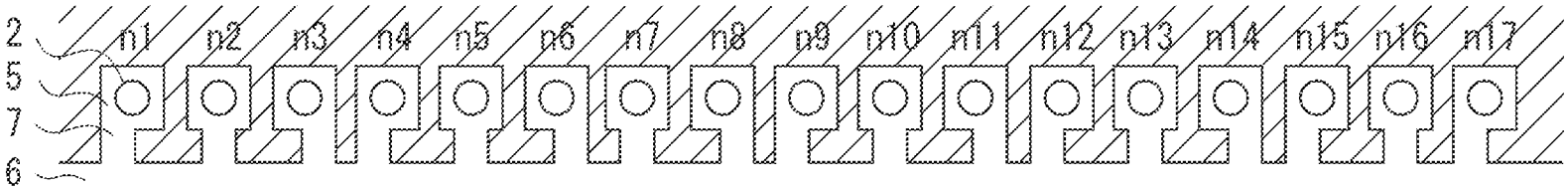
FIG. 7 illustrates a nozzle arrangement when the number of time divisions is sixteen according to the exemplary embodiment.

FIGS. 6 and 7 illustrate drive timings and a liquid flow path arrangement respectively when the number of time divisions is sixteen. FIG. 6 illustrates drive timings of discharge energy generation elements of seventeen adjacent nozzles n1 to n17. An average drive timing difference X of the sixteen nozzles in FIG. 6 is calculated by the following expression:

$$\frac{|n_1 - n_2| + |n_2 - n_3| + |n_3 - n_4| + \ldots + |n_{15} - n_{16}| + |n_{16} - n_{17}|}{16} = X$$

The average driving timing difference X=7.5 is acquired.

Thus, in FIG. 6, when a drive timing difference between discharge energy generation elements of the adjacent nozzles is larger than 7.5, a liquid inter-flow-path distance between the adjacent nozzles is set shorter. When the drive timing difference is smaller than 7.5, liquid inter-flow-path distances between the adjacent nozzles are set farther to each other. FIG. 7 illustrates this flow path arrangement. Only the liquid inter-flow-path distance is changed while a length and a width of a liquid flow path are not changed at each nozzle.

As in the aforementioned case, focusing on the nozzles n5 to n7, in the nozzles n5 and n6 where discharge timings are close, liquid inter-flow-path distances are set far from each other to reduce the influence of crosstalk. In the nozzles n6 and n7 where discharge timings are sufficiently shifted, liquid inter-flow-path distance is set close to each other. As a result, the influence of crosstalk can be reduced at the entire nozzles, thus realizing a stable operation.

A change amount of the liquid inter-flow-path distance can be set, in view of flow resistances of the nozzles and ink physical properties, to enable a stable operation at the entire nozzles. Basically, whether to set the inter-flow-path distance close to or far from each other is determined based on an average value of discharge timings or a discharge timing difference between the adjacent nozzles.

In the present exemplary embodiment, all the liquid inter-flow-path distances corresponding to the case where the drive timing difference from the adjacent discharge energy generation element is larger than the average value X are set close to one another, while all the liquid inter-flow-path distances corresponding to the case where the drive timing difference is smaller than the average value X are set far from one another. However, all the liquid inter-flow-path distances may not be set close to or far from one another. Setting far from one another the liquid inter-flow-path distances corresponding to the case where the drive timing difference from the adjacent discharge energy generation element is smaller than the average value X enables reduction of crosstalk between the adjacent nozzles corresponding to the liquid flow paths thereof.

It is desirable to set the drive timing difference of at least the adjacent discharge energy generation element to be separated farther than the liquid inter-flow-path distance of the nozzles corresponding to a minimum discharge energy generation element in the nozzle array.

A value A smaller than the average drive timing X can be set. Liquid inter-flow-path distances corresponding to a case where a drive timing difference is smaller than X−A can be set far from each other, liquid inter-flow-path distances corresponding to a case where a drive timing difference is larger than X+A can be set close to each other, and all liquid inter-flow-path distances corresponding to a case where a discharge energy generation element of drive timing difference X±A, can be set equal.

The present exemplary embodiment is applied to the ink jet recording head where the liquid flow paths of nozzles in the same drive section are equal in length, width, and flow resistance. However, the present invention can be applied to an ink jet recording head where such factors are different. When necessary, a noise filter can be provided.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2010-025866 filed Feb. 8, 2010, which is hereby incorporated by reference herein in its entirety.

What is claimed is:

1. An ink jet recording head, comprising:

a nozzle array including nozzles arranged in longitudinal rows, the nozzles including discharge ports to discharge liquid when recording, pressure chambers configured to communicate with respective discharge ports, and liquid flow paths configured to supply liquid to the respective pressure chambers;

discharge energy generation elements configured to apply, in response to receiving time-division driving based on a predetermined signal order, discharge energy to the pressure chambers to discharge liquid from the nozzles in a predetermined discharge order during time-division driving; and a time-division drive system configured to drive the discharge energy generation elements at different times, wherein adjacent liquid flows paths are separated from each other by a distance interval as measured in a straight line direction of a longitudinal row, and wherein arranging intervals of the liquid flow paths take at least two different values, and wherein, when a drive timing difference average X between the adjacent a discharge energy generation elements is calculated by the following expression:

$$\frac{|n_1 - n_2| + |n_2 - n_3| + |n_3 - n_4| + \ldots + |n_{N-1} - n_N| + |n_N - n_{N+1}|}{N} = X$$

where N indicates, as a quantity, a number of divisions for the time-division driving, and where drive timings of adjacent N discharge energy generation elements are set to $n_1$ for a first discharge energy generation element, $n_2$ for a discharge energy generation element adjacent to the first discharge energy generation element, and similarly set for $n_3$ to $n_N$, where n=1 to N, a relationship of D≥Y is satisfied between a distance interval D and a distance interval Y in a k-th discharge energy generation element and a k+1-th discharge energy generation element that is adjacent to the k-th discharge energy generation element, where the distance interval D is a distance between a liquid flow path corresponding to a k-th discharge energy generation element where $|n_k - n_{k+1}| < X$ is satisfied, and a liquid flow path corresponding to the k+1-th discharge energy generation element, and where the interval Y is a distance between a liquid flow path corresponding to the k-th discharge energy generation element where $|n_k - n_{k+1}| > X$ is set, and a liquid flow path corresponding to the k+1-th discharge energy generation element.

2. The ink jet recording head according to claim 1, wherein, when a value A is smaller than the drive timing difference average X of the discharge energy generation elements, relationships of D1≥D2≥Y2≥Y1, D1>Y2, and D2>Y1 are satisfied among (i) a distance interval D1 between a liquid flow path corresponding to the k-th discharge energy generation element where $|n_k - n_{k+}| < X - A < X$ is satisfied and the liquid flow path corresponding to the k+1-th discharge energy generation element, (ii) an interval D2 between a liquid flow path corresponding to the k-th discharge energy generation element where $X - A < |n_k - n_{k+1}| < X$ is satisfied and the liquid flow path corresponding to the k+1-th discharge energy generation element, (iii) a distance interval Y1 between the liquid flow path corresponding to a k-th discharge energy generation element where $|n_k - n_{k+1}| > X + A > X$ is satisfied and the liquid flow path corresponding to the k+1-th discharge energy generation element, and (iv) an interval Y2 between a liquid flow path corresponding to the k-th discharge energy generation element where $X + A > |n_k - n_{k+1}| > X$ is satisfied and the liquid flow path corresponding to the k+1-th discharge energy generation element.

3. The ink jet recording head according to claim 1, wherein distance intervals of the pressure chambers in the nozzle array, as measured in a straight line direction of a longitudinal row, are equal.

4. An ink jet recording head, comprising:

a nozzle array including a plurality of nozzles arranged in a plurality of longitudinal rows, wherein each row is divided into a predetermined number of groups of consecutive nozzles, wherein one nozzle from each group is part of a drive division, wherein each nozzle includes a discharge port, a pressure chamber configured to communicate with the discharge port, and a liquid flow path configured to supply liquid to the pressure chamber, wherein adjacent liquid flows paths are separated from each other by a distance interval as measured in a straight line direction of a longitudinal row;

a plurality of discharge energy generation elements, wherein, for each nozzle in a drive division, an associated discharge energy generation element is configured to apply, in response to receiving a time-division drive signal based on a predetermined signal order, discharge energy to generate pressure waves to discharge liquid from the pressure chambers and associated discharge ports in the drive division; and a time-division drive system configured to drive the plurality of discharge energy generation elements at different times, wherein each nozzle in a group has a drive timing represented by a unique positive integer, an absolute value difference between two adjacent nozzles forms a drive timing difference, and an average value of the drive timing differences in a group forms a drive timing difference average X, wherein, in a case where a first nozzle, having a first liquid flow path, and a second nozzle, having a second liquid flow path adjacent to the first liquid flow path, have a drive timing difference that is equal to the drive timing difference average X, the distance interval between the first liquid flow path and the second liquid flow path is set equal to a distance interval d, wherein, in a case where the first nozzle and the second nozzle have a drive timing difference that is larger than the drive timing difference average X, the distance interval between the first liquid flow path and the second liquid flow path is set to a distance interval Y that is approximated to the distance interval d, and wherein, in a case where the first nozzle and the second nozzle have a drive timing difference that is smaller than the drive timing difference average X, the distance interval between the first liquid flow path and the second liquid flow path is set to a distance interval D that is larger than the distance interval d, whereby, due to any of the distance interval d, the distance interval Y, and the distance interval D, liquid is discharged from the second nozzle adjacent to the first nozzle at a timing during which vibration of a liquid surface of the second nozzle due to crosstalk from the first nozzle has decreased from a peak vibration so as to not hinder achievement of a higher printing speed.

5. The ink jet recording head according to claim 4, wherein the distance interval Y is set smaller than the distance interval d.

6. The ink jet recording head according to claim 4, wherein the peak vibration corresponds to a peak meniscus amplitude of liquid in the second nozzle as measured from a flat meniscus state.

7. The ink jet recording head according to claim 6, wherein the peak meniscus amplitude corresponds to a convex meniscus state.

8. The ink jet recording head according to claim 4, wherein each drive division is a drive block that includes sixteen nozzles.

9. The ink jet recording head according to claim 4, wherein time intervals between each consecutive time-division drive signals are set equal.

10. The ink jet recording head according to claim 4, wherein adjacent discharge ports include centerlines that are aligned in a direction of their longitudinal row to have same liquid flow path lengths.

11. The ink jet recording head according to claim 4, wherein widths of each liquid flow path are set equal.

12. The ink jet recording head according to claim 4, wherein distance intervals between each consecutive pressure chambers are set equal.

13. An ink jet recording head, comprising:

a nozzle array including a plurality of nozzles arranged in a plurality of longitudinal rows, wherein each row is divided into a predetermined number of groups of consecutive nozzles, wherein one nozzle from each group is part of a drive division, wherein each nozzle includes a discharge port, a pressure chamber configured to communicate with the discharge port, and a liquid flow path configured to supply liquid to the pressure chamber, wherein adjacent liquid flows paths are separated from each other by a distance interval as measured in a straight line direction of a longitudinal row;

a plurality of discharge energy generation elements, wherein, for each nozzle in a drive division, an associated discharge energy generation element is configured to apply, in response to receiving a time-division drive signal based on a predetermined signal order, discharge energy to generate pressure waves to discharge liquid from the pressure chambers and associated discharge ports in the drive division; and a time-division drive system configured to drive the plurality of discharge energy generation elements at different times, wherein each nozzle in a group has a drive timing represented by a unique positive integer, an absolute value difference between two adjacent nozzles forms a drive timing difference, an average value of the drive timing differences in a group forms a drive timing difference average X, and a value A smaller than the drive timing difference average X is set, wherein, in a case where a first nozzle, having a first liquid flow path, and a second nozzle, having a second liquid flow path adjacent to the first liquid flow path, have a drive timing difference that is equal to or within a range from a difference between the drive timing difference average X and the value A and a sum of the drive timing difference average X and the value A, the distance interval between the first liquid flow path and the second liquid flow path is set equal to a distance interval d, wherein, in a case where the first nozzle and the second nozzle have a drive timing difference that is larger than the sum of the drive timing difference average X and the value A, the distance interval between the first liquid flow path and the second liquid flow path is set to a distance interval Y that is smaller than the distance interval d, and wherein, in a case where the first nozzle and the second nozzle have a drive timing difference that is smaller than the difference between the drive timing difference average X and the value A, the distance interval between the first liquid flow path and the second liquid flow path is set to a distance interval D that is larger than the distance interval d, whereby, due to any of the distance interval d, the distance interval Y, and the distance interval D, liquid is discharged from the second nozzle adjacent to the first nozzle at a timing during which vibration of a liquid surface of the second nozzle due to crosstalk from the first nozzle has decreased from a peak vibration so as to not hinder achievement of a higher printing speed.

14. An ink jet recording head to discharge liquid when recording, the ink jet recording head comprising:

a plurality of discharge energy generation elements having a drive order, wherein the drive order is a predetermined drive order that indicates a fixed positive whole number numerical sequence in which each discharge energy generation element is to discharge energy;

a time-division drive system configured to drive the plurality of discharge energy generation elements at different times; and a nozzle array having a plurality of nozzles arranged in longitudinal rows, wherein each nozzle includes a liquid flow path, a discharge port configured to discharge liquid, and a pressure chamber configured to receive liquid from the liquid flow path and receive energy from a discharge energy generation element, wherein each liquid flow path is separated from an adjacent liquid flow path by an adjacent flow paths distance, wherein each adjacent flow paths distance is measured in a straight line direction of a longitudinal row from a center of one liquid flow path to a center of the adjacent liquid flow path, wherein each adjacent flow paths distance of the plurality of nozzles in the ink jet recording head is based on the predetermined drive order of the plurality of discharge energy generation elements, wherein N indicates a largest number in the predetermined drive order, wherein $n_1$ through $n_{N+1}$ indicates a nozzle number of each adjacent nozzles wherein each nozzle is associated with a predetermined drive order, wherein X indicates an average drive order difference as an average value of drive order differences between adjacent nozzles that is calculated by a first expression:

$$\frac{|n_1 - n_2| + |n_2 - n_3| + |n_3 - n_4| + \ldots + |n_{N-1} - n_N| + |n_N - n_{N+1}|}{N} = X$$

wherein a k-th indicates a discharge energy generation element, wherein an adjacent flow paths distance D is a distance between a first liquid flow path corresponding to a k-th discharge energy generation element where a second expression $|n_k - n_{k+1}| < X$ is satisfied and a second liquid flow path corresponding to the k+1-th discharge energy generation element, wherein an adjacent flow paths distance Y is a distance between a third liquid flow path corresponding to a k-th discharge energy generation element where a third expression $|n_k - n_{k+1}| > X$ is satisfied, and a fourth liquid flow path corresponding to the k+1-th discharge energy generation element, and wherein, based on the predetermined drive order of the plurality of discharge energy generation elements, the adjacent flow paths distance D is greater than or equal to the adjacent flow paths distance Y.

15. The ink jet recording head of claim 14, wherein, based on the predetermined drive order, a first adjacent flow paths distance has a value that is different from a value for a second adjacent flow paths distance.

16. The ink jet recording head of claim 14, wherein, if each adjacent flow paths distance were arranged at equal intervals, each adjacent flow paths distance would measure an equal adjacent flow paths distance d, and wherein an average value of drive order differences between all the adjacent nozzles in the plurality of nozzles defines an average drive order difference X, wherein the plurality of nozzles includes a first nozzle and a second nozzle adjacent to and separated from the first nozzle by a second adjacent flow paths distance D, wherein a difference between the drive order of the first nozzle and the second nozzle define a first-second nozzles order difference, and wherein the second adjacent flow paths distance D is larger than the first adjacent flow paths distance d based on the first-second nozzles order difference being smaller than the average drive order difference X.

17. The ink jet recording head of claim 14, wherein liquid flow paths of nozzles in a same drive section are equal in length, width, and flow resistance and at least two nozzles in that same drive section have different nozzle shapes as a result of an adjacent flow paths distance to reduce an influence of crosstalk between adjacent nozzles.

18. The ink jet recording head of claim 14, wherein the nozzle array is divided into a plurality of groups, wherein each group includes a same number of nozzles and each group includes at least four nozzles, wherein the predetermined drive order is repeated for each group, wherein the number of nozzles in a group matches a largest number in the predetermined drive order.

19. The ink jet recording head of claim 18, wherein each group includes four to sixteen nozzles.

* * * * *